US012167787B2

(12) United States Patent
Stults

(10) Patent No.: US 12,167,787 B2
(45) Date of Patent: Dec. 17, 2024

(54) CADDY ACCESSORY FOR A PESTICIDE SPRAY CANISTER

(71) Applicant: Matthew Corey Stults, Florence, AL (US)

(72) Inventor: Matthew Corey Stults, Florence, AL (US)

( * ) Notice: Subject to any disclaimer, the term of this patent is extended or adjusted under 35 U.S.C. 154(b) by 6 days.

(21) Appl. No.: 18/156,636

(22) Filed: Jan. 19, 2023

(65) Prior Publication Data

US 2024/0245204 A1 Jul. 25, 2024

(51) Int. Cl.
*A45F 5/00* (2006.01)

(52) U.S. Cl.
CPC ..... *A45F 5/00* (2013.01); *A45F 2200/0566* (2013.01)

(58) Field of Classification Search
CPC ..... A45F 5/00; A45F 2200/0566; A45F 2200/05; A45F 2005/002; B25H 3/00; B25H 3/006
USPC ..... 206/349, 207
See application file for complete search history.

(56) References Cited

U.S. PATENT DOCUMENTS 5,103,977 A * 4/1992 Douglas ..... H02G 11/02 206/408
6,401,993 B1 * 6/2002 Andrino ..... A45F 5/00 D3/229
8,573,373 B2 * 11/2013 Rothschild ..... A63H 33/006 206/349
2003/0062278 A1 * 4/2003 Bean ..... A45D 1/00 206/349
2004/0226841 A1 * 11/2004 Ginder, Jr. ..... A45C 11/26 206/349
2005/0167306 A1 * 8/2005 Ho ..... B25H 3/023 206/349
2006/0144732 A1 * 7/2006 Kaplan ..... B25H 3/00 206/349
2006/0219587 A1 * 10/2006 Redzisz ..... A45C 13/04 206/349
2008/0210730 A1 * 9/2008 Williams ..... B25H 3/006 224/663
2012/0187138 A1 * 7/2012 Vasquez ..... A45C 15/00 220/739
2014/0346821 A1 * 11/2014 Flis ..... A45F 5/00 224/665
2015/0021346 A1 * 1/2015 Cappuccio ..... A45F 5/00 220/735
2019/0200718 A1 * 7/2019 Sturm ..... A45C 11/38
(Continued)

FOREIGN PATENT DOCUMENTS

WO WO-0107311 A1 * 2/2001 ..... B62B 1/264
WO WO-2009140531 A2 * 11/2009 ..... A45C 9/00
WO WO-2019144110 A1 * 7/2019 ..... A01M 7/0046

*Primary Examiner* — Rafael A Ortiz
(74) *Attorney, Agent, or Firm* — George P Kobler

(57) ABSTRACT

A caddy for a pesticide spray canister includes a generally cylindrical sleeve which encloses the canister with an expandable pocket disposed on one exterior side of the sleeve wall and a pouch formed by a pouch wall affixed to the exterior of said sleeve wall. The caddy also includes a small canister pouch and a generally circular top secured to the upper rim of the sleeve wall, the top having a central aperture defined therein for receiving the spray canister pump handle and a second aperture defined therein disposed radially outward from the central aperture for accommodating a spray hose attachment fitting.

6 Claims, 9 Drawing Sheets

(56) References Cited

U.S. PATENT DOCUMENTS

| | | | | |
|---|---|---|---|---|
| 2020/0085177 | A1* | 3/2020 | Walk | A45C 3/001 |
| 2021/0137248 | A1* | 5/2021 | Dow | A47G 23/02 |

* cited by examiner

CADDY ACCESSORY FOR A PESTICIDE SPRAY CANISTER

BRIEF DESCRIPTION OF THE DRAWINGS

The apparatus is described with reference to the accompanying drawings. In the drawings, like reference numbers indicate identical or functionally similar elements.

DETAILED DESCRIPTION

The various embodiments of the caddy accessory for a pesticide spray canister and their advantages are best understood by referring to FIGS. 1 through 9 of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

Figure 1:
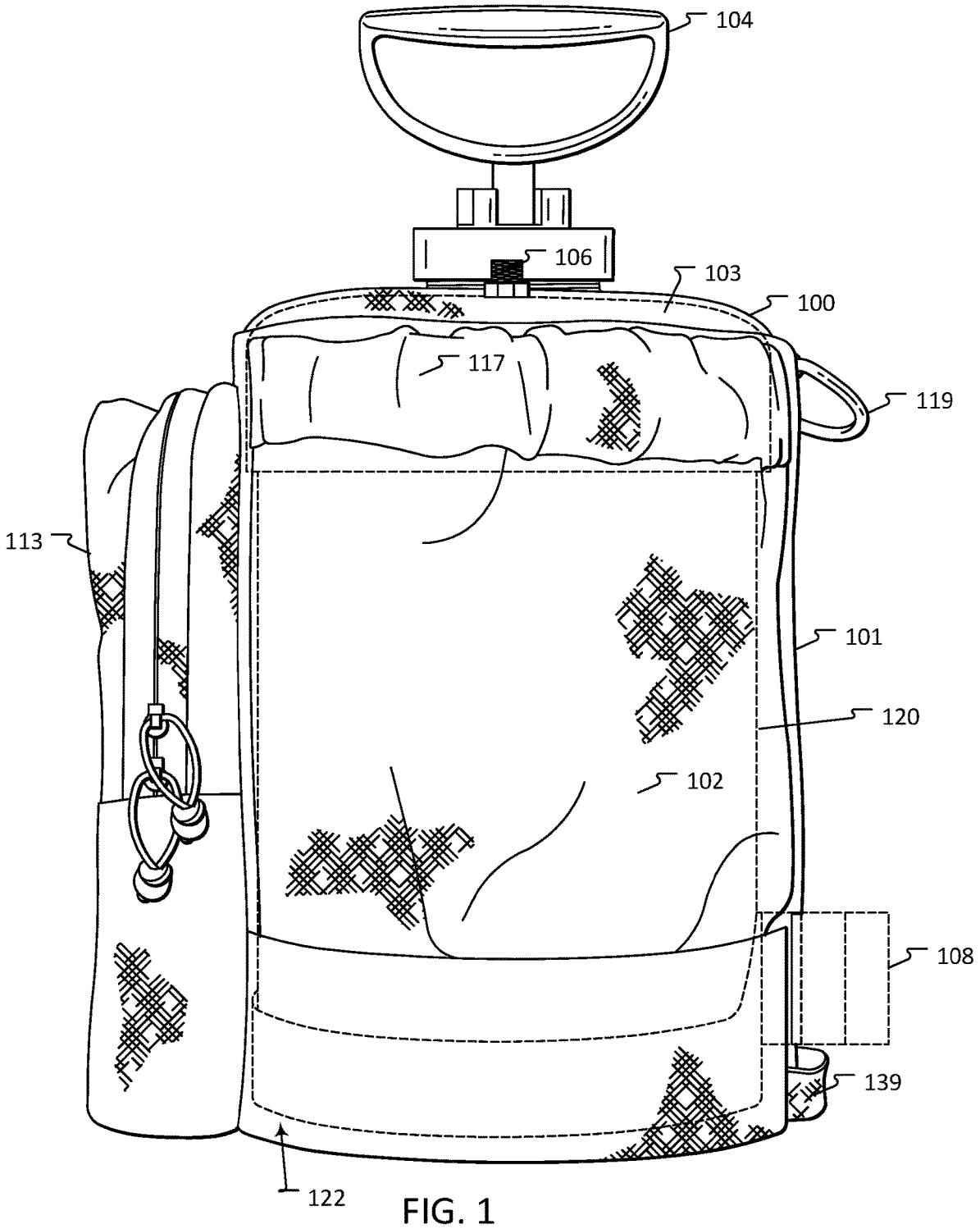
FIG. 1 is an elevational view of an exemplary sleeve accessory for a pesticide spray canister with a spray canister (shown in dotted lines) within the sleeve.
Figure 2:
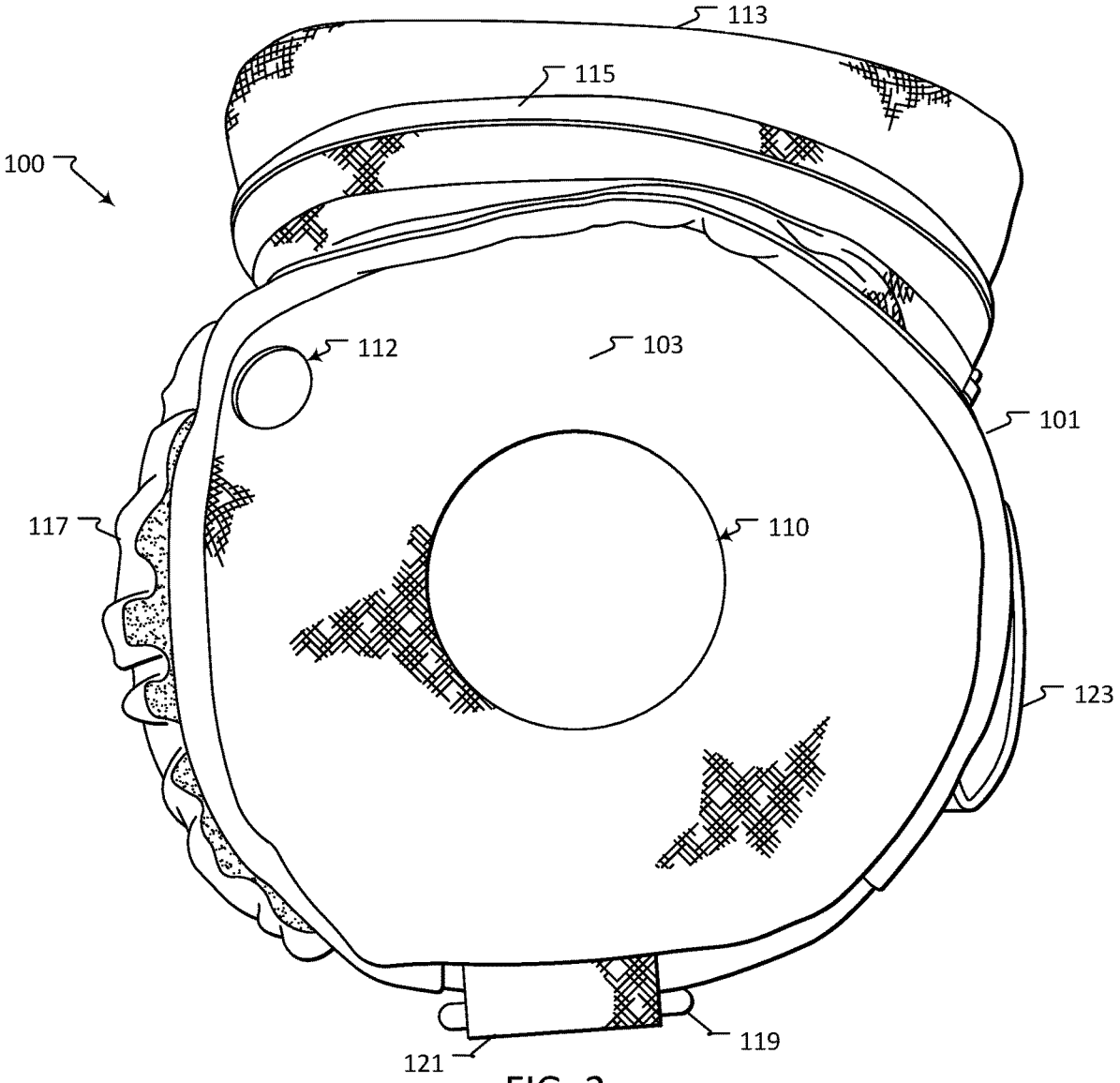
FIG. 2 is a top plan view of the sleeve accessory of FIG. 1 without the spray canister.
Figure 3:
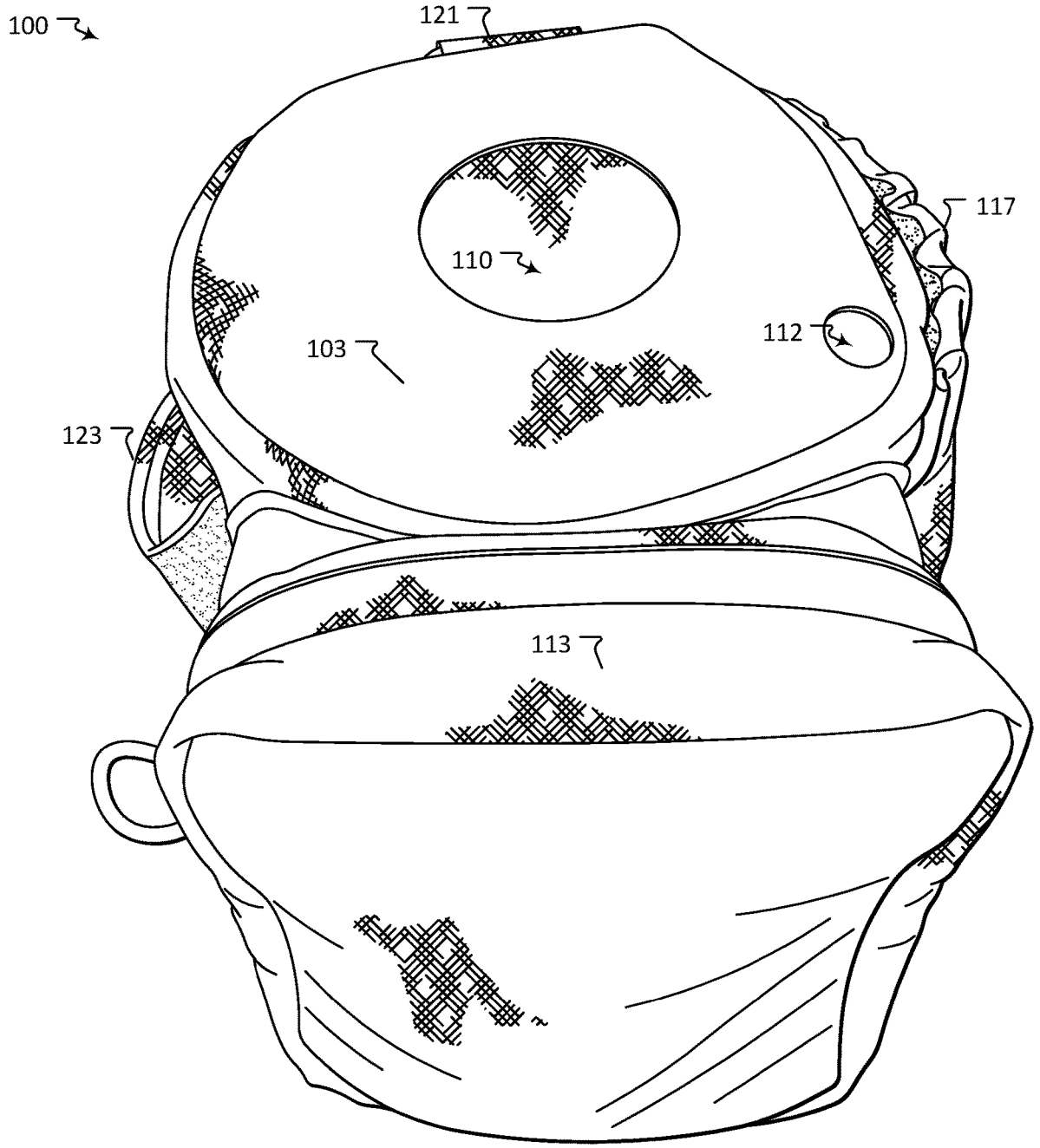
FIG. 3 is a top perspective view of the sleeve accessory from a first angle.

Referring first to FIG. 1, the pesticide spray canister 120 is of the type that generally includes a container cylinder 102 (shown in dotted lines) for containing the pesticide fluid with a pump handle 104 extending from the top of the cylinder 102 generally aligned with the longitudinal axis of the cylinder 102. Also extending from the top of the cylinder 102 but radially outward from the pump handle 104 is a spray hose attachment fitting 106 to which a spray hose (not shown) is coupled. The spray canister 120 may also include a spray wand holder flange 108 that would extend from the lower portion of the cylinder 102 and which would be for holstering a spray wand (not shown). A non-limiting example of a spray canister suited for use with the sleeve accessory is the B&G one gallon canister produced and sold by B&G.

This embodiment of the inventive caddy accessory 100 comprises a generally cylindrical sleeve wall 101 in which is defined a generally cylindrical space for enclosing the container cylinder 102. Attached to the top rim of the sleeve wall 101 is generally circular top 103 in which is defined two apertures. A first aperture 110 is dimensioned for receiving the pump handle 104 and is defined generally in the center of the top 103. A second smaller aperture 112 is defined in the top 103 toward the edge of thereof and is dimensioned for receiving the spray hose attachment fitting 106. Further, an aperture 116 may be defined in the sleeve wall 101 toward the lower portion thereof to accommodate the spray wand holder flange 108.

The sleeve is preferably constructed from a flexible, durable fabric, for example, a synthetic material such as nylon. Preferably, such a fabric possesses high resistance to abrasion and high tensile strength, and so is resistant to tearing. Further, the fabric should be liquid repellant. An example of a suitable fabric is offered under the Cordura® brand, specifically Cordura 500D and 1000D, sold by Invista of Wichita, Kansas.

Figure 4:
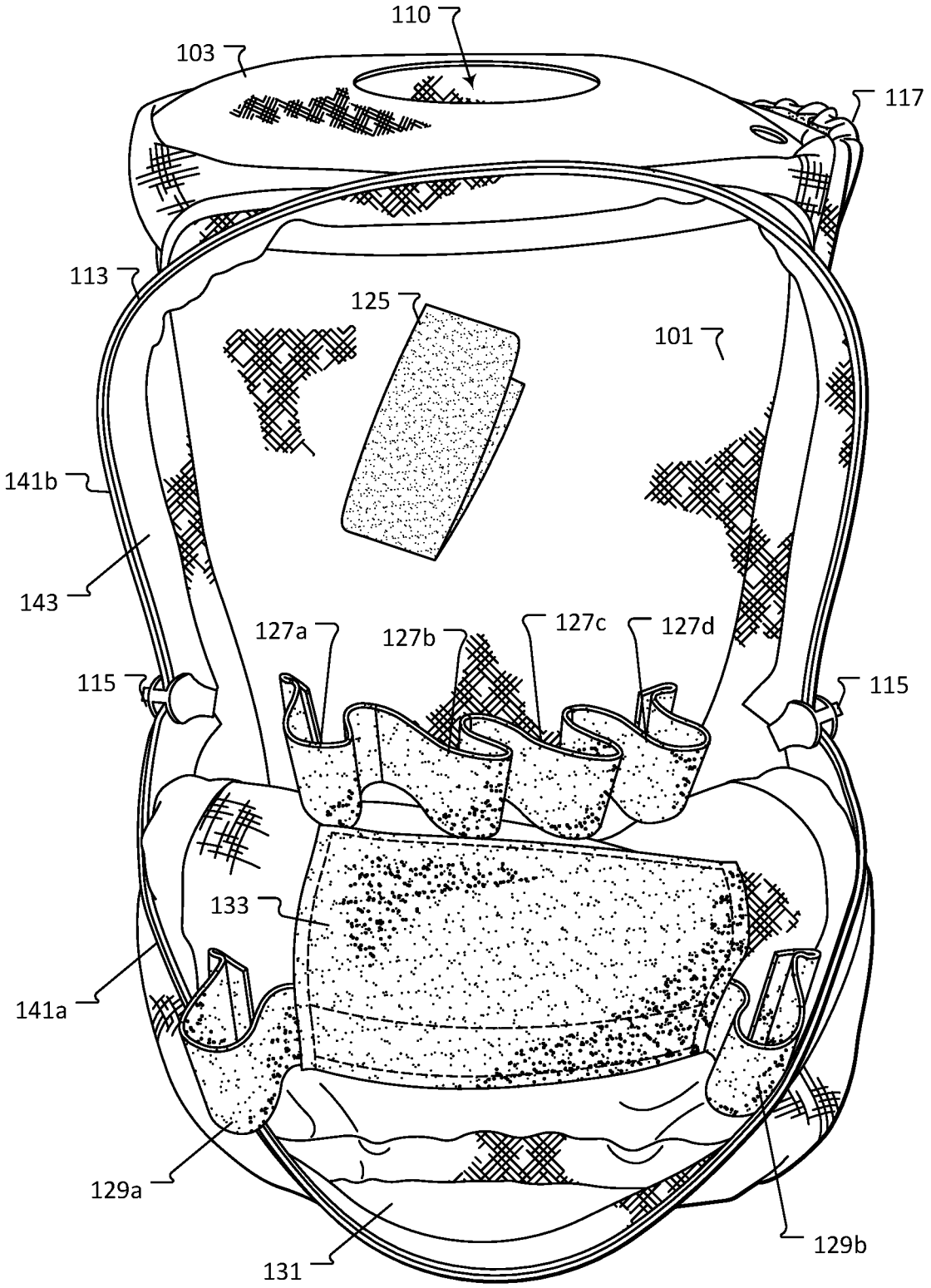
FIG. 4 is a perspective view of the sleeve accessory showing an opened zippered pocket.
Figure 5:
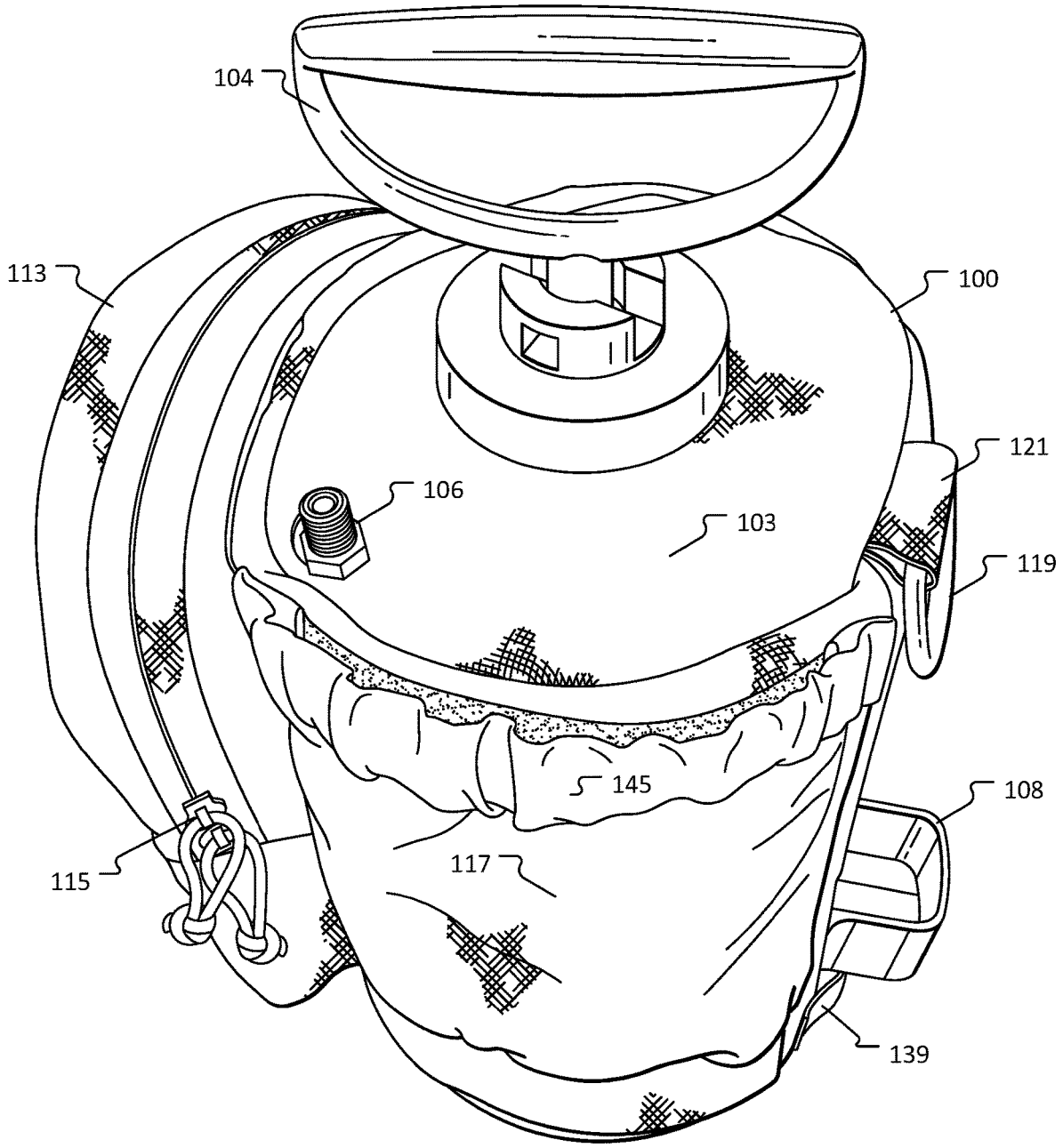
FIG. 5 is a top perspective view of the sleeve accessory of FIG. 1 from a second angle with the spray canister within the sleeve.

Advantageously, the exemplary caddy 100 may be equipped with several storage features such as an expandable pouch 113 and a conforming side pouch 117. The caddy 100 may also comprise a small canister pouch 123. Referring to FIG. 4 of the drawings, the expandable pouch 113 may be configured an exterior flap 131 having a row of zipper teeth 141*a* attached to the perimeter of the flap 131 and that mate with a corresponding row of zipper teeth 141*b* attached to the perimeter of a pouch wall 143 extending radially outward from the sleeve wall 101, the expandable pouch being closed by means of a zipper slide 115 in the conventional manner.

The interior of the expandable pouch 113 may advantageously include an interior pocket 133 disposed on the interior of the flap 131 as well as one or more retaining loops 129*a, b* extending from the interior of the flap 131. A plurality of vertically-oriented retaining loops 127*a-d* may extend from the sleeve wall 101 in the pouch interior. A retaining strap 125 may also be attached to the sleeve wall 101 in the pouch interior.

Figure 6:
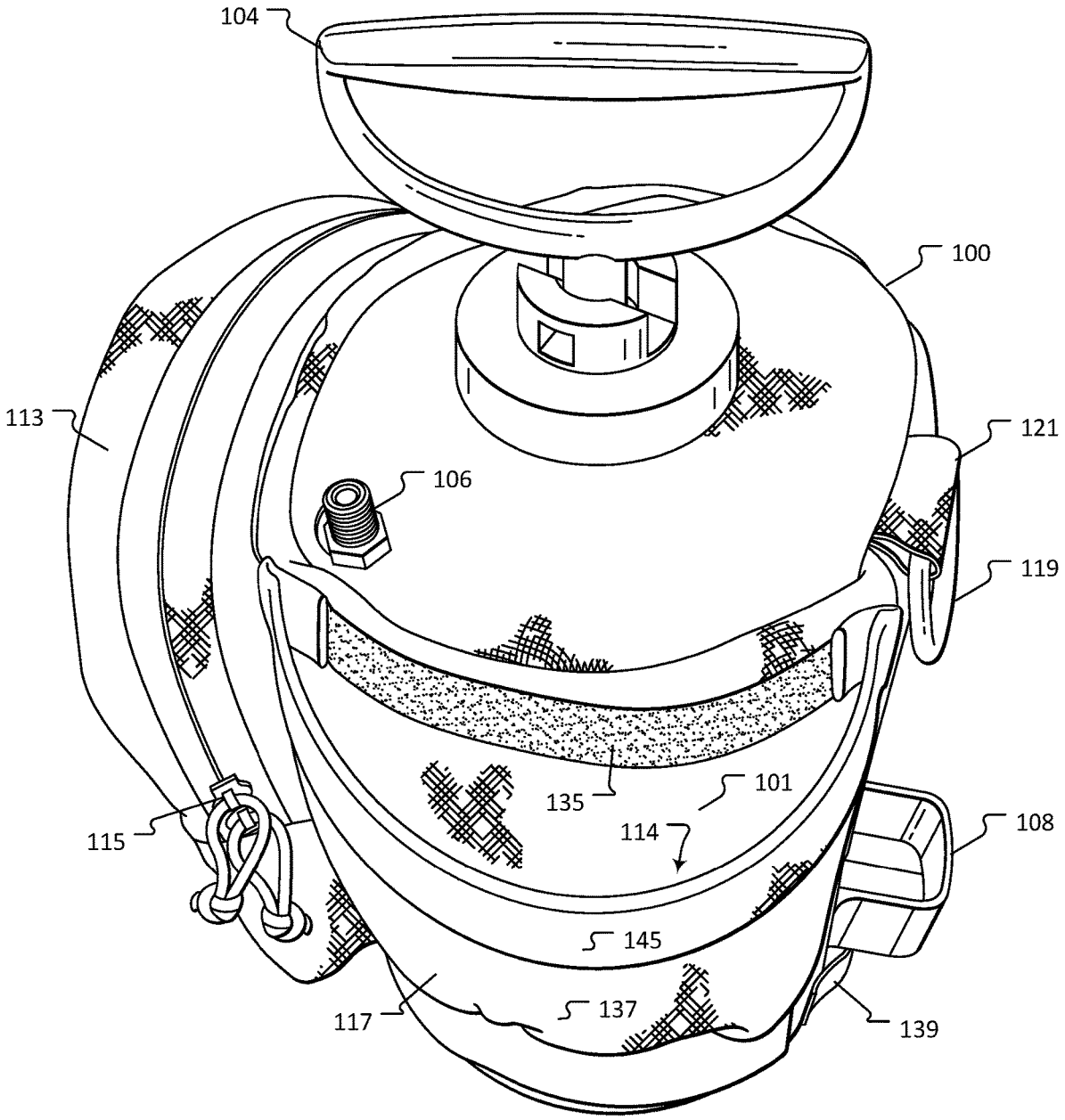
FIG. 6 is a top perspective view of the sleeve accessory according to FIG. 5 depicting the conformable side pouch extended away from the side wall.

FIG. 6 depicts the conforming pouch 117 in an open position illustrating an exterior pouch wall 137 secured on vertical edges to the sleeve wall 101. The exterior pouch wall 137 generally conforms somewhat to the cylindrical shape of the sleeve wall 101 but dimensioned to have a slightly larger radius with respect to the center axis of the sleeve such that the pouch wall and the sleeve wall 101 together define a pouch cavity 114. The upper interior rim of the exterior pouch wall preferably includes closing means, for example, VELCRO®, that mates with corresponding closing means 135 on the sleeve wall 101. Preferably, the upper rim of the pouch includes an elastic band 145.

Figure 8:
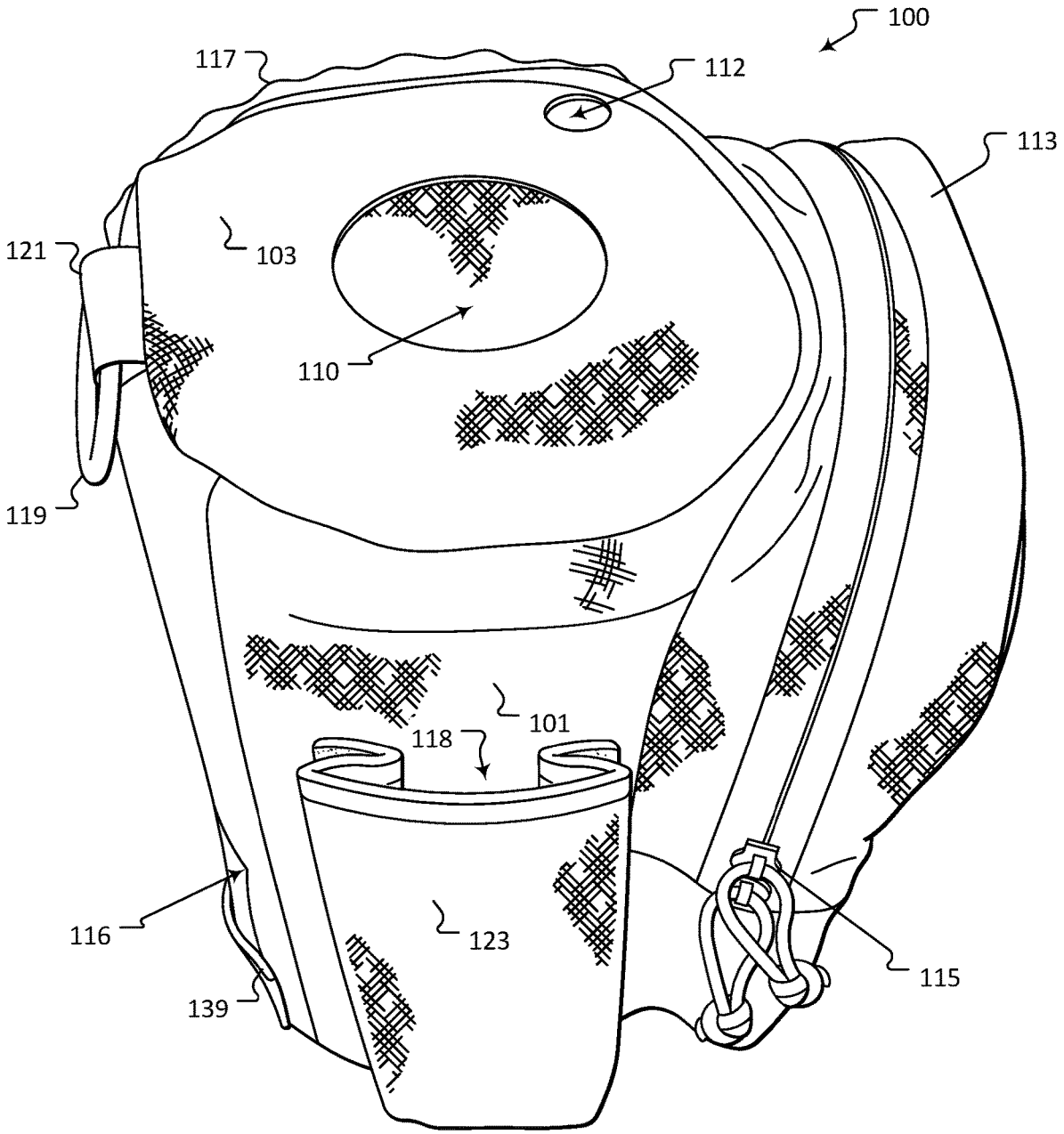
FIG. 8 is a top perspective view of the sleeve accessory from yet another angle.
Figure 9:
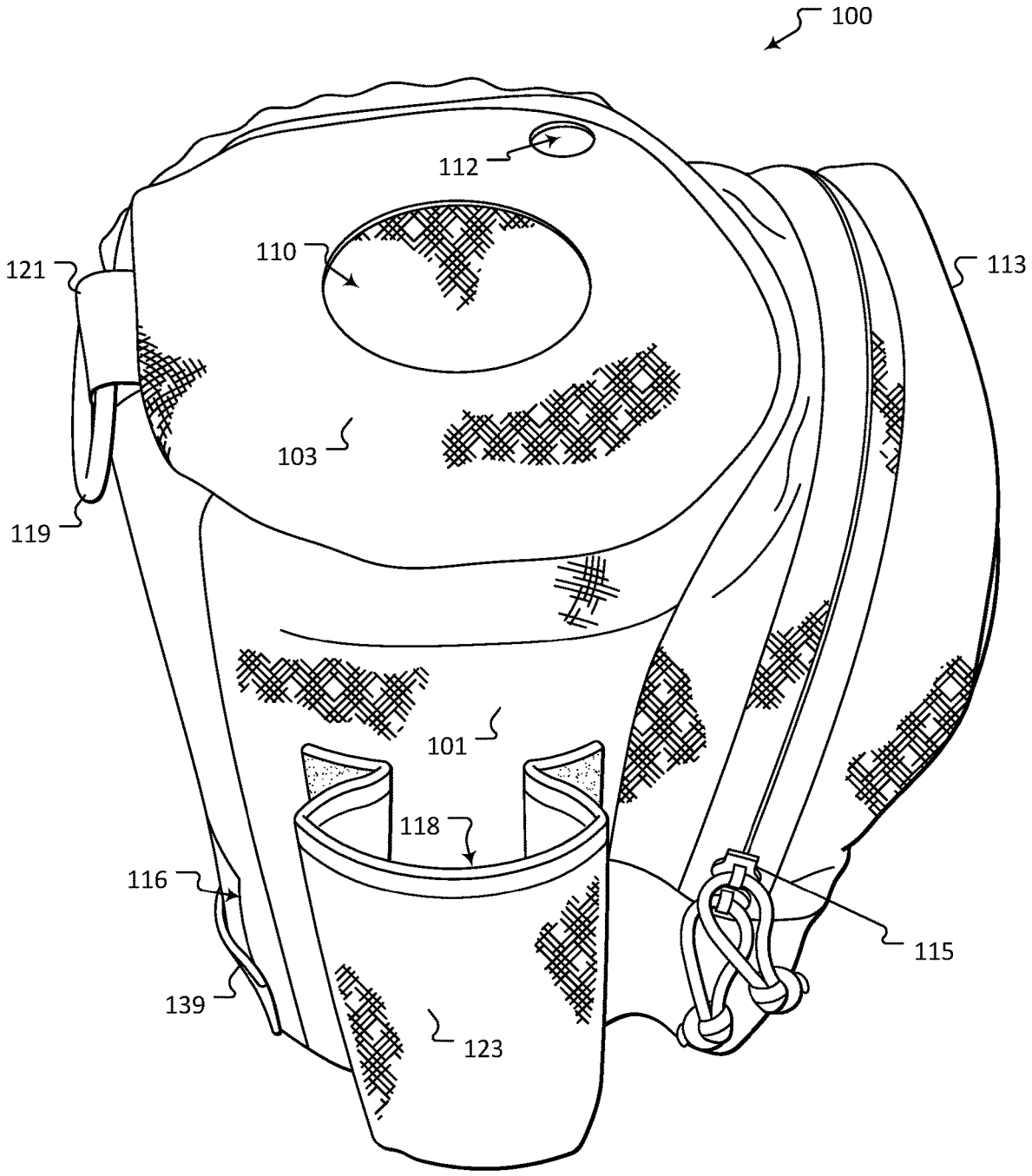
FIG. 9 is a top perspective view of the sleeve accessory according to FIG. 8 showing small canister pocket extended from the sleeve wall.

As shown in FIGS. 8 & 9 the small canister pouch 123 may be disposed on sleeve wall 101 and is dimensioned to receive a small canister, for example an aerosol spray can. This pouch 123 is formed from a flexible piece of fabric secured at vertical sides to the sleeve wall 101, the fabric being sized such that a roughly cylindrical cavity 118 is formed between the fabric and the sleeve wall 101.

Figure 7:
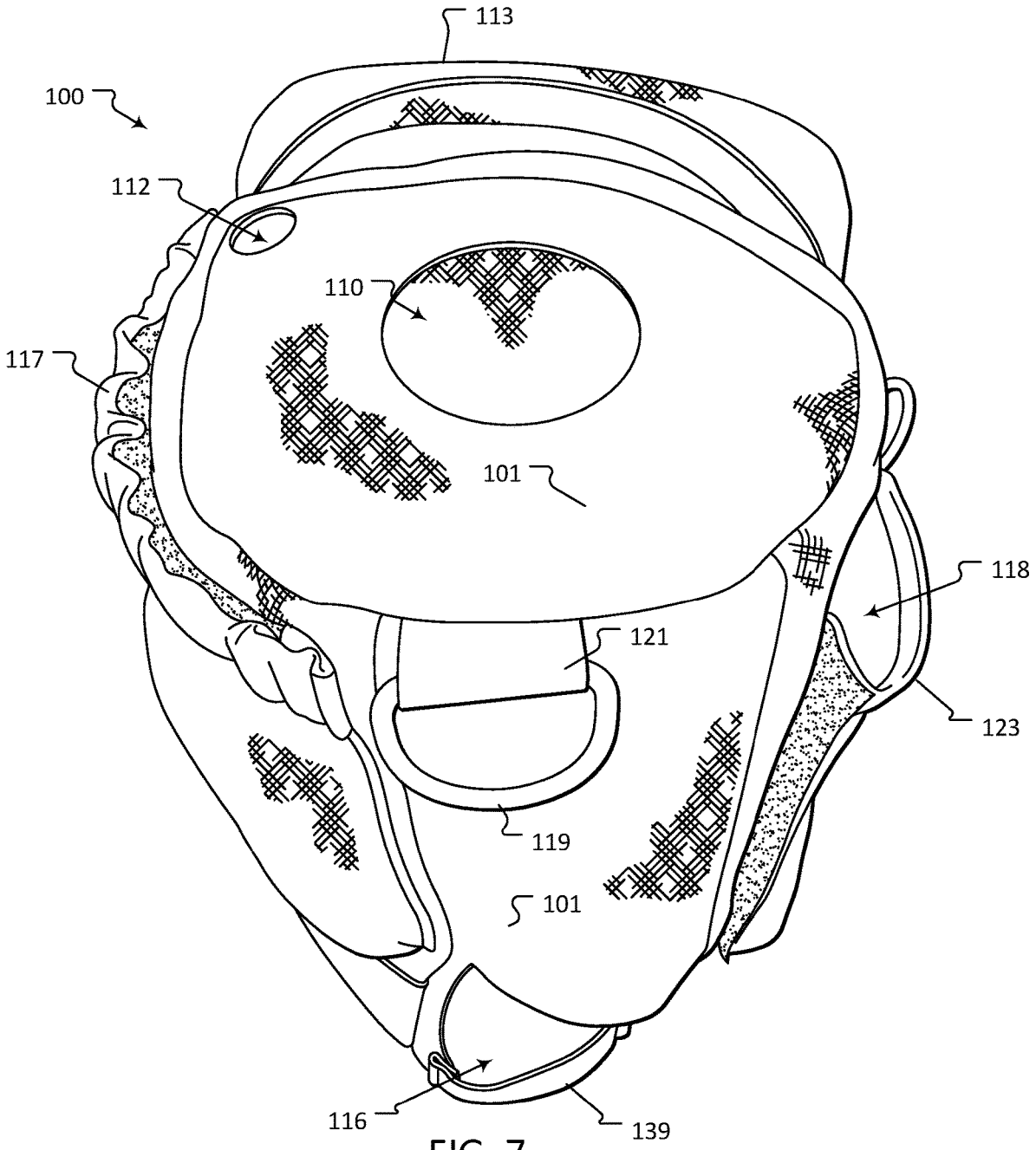
FIG. 7 is a top perspective view of the sleeve accessory from yet another angle.

As seen more clearly in FIG. 7, the caddy 100 may also comprise a d-ring 119 secured to the upper portion of the sleeve wall 101 with a d-ring attachment loop 121. The d-ring 119 is for added support for the spray wand (not shown). As mentioned above, an aperture 116 may be defined in the lower portion of the sleeve wall 101 to accommodate a spray wand holder flange 108. A strap 139 is included that spans one edge of the bottom of the aperture 116 to the opposite edge thereof for securing the caddy 100 to the canister 120.

As described above and shown in the associated drawings, the present invention comprises a sleeve accessory for a pesticide spray canister. While particular embodiments have been described, it will be understood, however, that any invention appertaining to the apparatus described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A caddy for a pesticide spray canister, said spray canister including a generally cylindrical canister and having a pump handle extending upward from the top of the canister aligned with the longitudinal axis thereof, and a spray hose attachment fitting extending upward from the top of the canister and disposed radially outward from the pump handle, said caddy comprising:

a generally cylindrical sleeve wall formed from a flexible fabric defining a generally cylindrical space within which may be enclosed the canister;

an expandable pocket disposed on one exterior side of the sleeve wall, said expandable pocket having closing means;

a conforming pouch formed by a pouch wall affixed to the exterior of said sleeve wall and having closing means along an upper rim thereof;

a small canister pouch disposed on the exterior of the sleeve wall;

a generally circular top formed from a flexible fabric secured to the upper rim of the sleeve wall, said top having a central aperture defined therein for receiving the pump handle and a second aperture defined therein disposed radially outward from the central aperture, said second aperture dimensioned to receive the spray hose attachment fitting.

2. The caddy of claim 1, further comprising a d-ring retained to the top of said sleeve wall with a retaining loop.

3. The caddy of claim 1, further comprising a plurality of retaining loops affixed within said expandable pocket to the exterior of said sleeve wall.

4. The caddy of claim 1, further comprising one or more retaining loops affixed within said expandable pocket.

5. The caddy of claim 1, wherein, said sleeve wall further comprises a side aperture defined in the lower portion of said sleeve wall through which a spray wand holder flange may be inserted.

6. The caddy of claim 5, further comprising a strap having an end attached to a first edge of said side aperture and a second end attached to a second edge of said side aperture.

* * * * *